US005683015A

United States Patent [19]

Lee

[11] Patent Number: 5,683,015

[45] Date of Patent: Nov. 4, 1997

[54] WATER DISPENSER HAVING A FILLABLE STORAGE VESSEL AND ADAPTED TO BE MOUNTED IN A REFRIGERATOR DOOR

[75] Inventor: Cha-Jun Lee, Suwon, Rep. of Korea

[73] Assignee: Samsung Electronics Co., Ltd., Suwon, Rep. of Korea

[21] Appl. No.: 570,554

[22] Filed: Dec. 11, 1995

[30] Foreign Application Priority Data

Dec. 12, 1994 [KR] Rep. of Korea ..... 94-33715 U
Oct. 21, 1995 [KR] Rep. of Korea ..... 95-36519

[51] Int. Cl.[6] ..... B67D 5/62

[52] U.S. Cl. ..... 222/146.6; 222/185.1; 222/509

[58] Field of Search ..... 222/146.6, 185.1, 222/325, 506, 509, 518, 545, 559; 62/389, 391

[56] References Cited

U.S. PATENT DOCUMENTS 2,039,624 5/1936 Bigelow ..... 222/509
2,562,212 7/1951 Rogers et al. ..... 222/185.1
3,298,571 1/1967 Novak ..... 222/509
4,271,992 6/1981 Becker ..... 222/509

*Primary Examiner*—Philippe Derakshani
*Attorney, Agent, or Firm*—Burns, Doane, Swecker & Mathis, L.L.P.

[57] ABSTRACT

A refrigerator includes a cold water dispenser mounted in the door thereof to enable water to be dispensed without the door being opened. The dispenser includes a housing mounted in the door and forming a dispensing chamber. A manually actuable lever is swingably mounted to the housing and is accessible exteriorly of the door. A hollow cylinder is mounted to the housing and extends into the refrigerating compartment. The cylinder forms a water conduit having a water outlet in the chamber and an upwardly facing water inlet spaced from the outlet. A slide is reciprocable in the cylinder and is pushed by swinging the lever. A water storage vessel is mounted on the cylinder so that a valved water passage on a lower portion thereof communicates with the water inlet. By pushing the lever, the slide is pushed to lift the valve to enable water to travel from the vessel to the water outlet. The water outlet has circumferentially spaced projections extending radially inwardly from an inner periphery thereof for guiding the water in straight-line flow during dispensing.

13 Claims, 5 Drawing Sheets

WATER DISPENSER HAVING A FILLABLE STORAGE VESSEL AND ADAPTED TO BE MOUNTED IN A REFRIGERATOR DOOR

BACKGROUND OF THE INVENTION

1. Field of the Invention

The present invention relates to a water dispenser of a refrigerator by which the water stored in the refrigerator can be dispensed without recourse to opening the refrigerator door.

2. Description of the Prior Art

Generally, a refrigerator serves to store a vessel of cold water for use in hot summer days, however, there is a problem in that frequent opening and closing of a door thereof causes temperature therein to soar, thereby increasing high electric consumption and inconvenience in use.

As a prior art, for example, Japanese Utility Model application No. Showa 50-37546 discloses a refrigerator having a cold water dispenser from which the cold water cooled therein can be dispensed to the outside, wherein, as illustrated in FIG. 1, a body 1 of the refrigerator having a refrigerating chamber 1*a* therein has a door 2 for free opening and closing, and the refrigerating chamber 1*a* is provided with a cold water vessel 3 for storing cold water therein.

The cold water vessel 3 is hingedly assembed at a lower side thereof to a manipulating lever 6 for operating to open and close a valve apparatus 4 to thereby discharge the cold water in the cold water vessel 3 into a cup 5.

The manipulating lever 6, as illustratd in FIG. 2, is releasably, resiliently and hingedly assembled to a support point 7 fixedly disposed on the door 2, and, at one side thereof, is protrudingly and upwardly formed with a manipulating rod 6*a*.

The valve apparatus 4 for being opened and closed according to manipulation of the manipulating lever 6 includes a valve operator 8 for being resiliently disposed so as to be slidingly operated up and down according to up and down operation of the manipulating rod 6*a*, and a valve body 10 for being operated up and down in association with the valve operator 8 to thereby open or close a dispensing outlet 9 formed at one side thereof.

Accordingly, when the cold water in the refrigerating chamber 1*a* is to be dispensed outside, a tip end of the manipulating lever 6 is downwardly operated to thereby cause the manipulating rod 6*a* formed at one side thereof to ascend and also to cause the valve operator 8 of the valve apparatus 4 to ascend.

Successively, the valve body 10 is distanced from an upper end of the disposal outlet 9 at a predetermined interval according to the up and down operation of the valve operator 8, so that the cold water in the cold water vessel 3 is dispensed into the cup 5 through the disposal outlet 9.

At this time, when force applied to the manipulating lever 6 is released, the valve operator 8 is lowered by resilience of resilient member to thereby cause the valve body 10 to tightly adhere to an upper end of the disposal outlet 9 and to stop discharge of the cold water.

However, there is a problem in the aforesaid conventional structure in that, though there is an advantage in that easy releasability of the manipulating lever enables the apparatus to be cleaned, the flow of the cold water from the disposal outlet 9 during normal dispensing is sprayed in all directions to produce a large quantity of dripping water on surrounding surfaces.

There is another problem in that, it is very inconvenient to use because one hand has to hold the cup or the like while the other hand has to manipulate the manipulating lever during water dispensing, and on top of that, when a water dispenser is to be installed at a lower side of the door and relies upon downward operation of the manipulating lever for water discharged, it is very inconvenient to manipulate and difficult in application.

SUMMARY OF THE INVENTION

Accordingly, the present invention is disclosed to solve the aforementioned problems and it is an object of the present invention to provide a water dispenser of a refrigerator which is easy in operation and convenient in use, and, at the same time, which makes no mistakes in operation of a valve body and makes straight flow of the cool water disposed therefrom to thereby minimize generation of residual water and dripping water.

It is another object of the present invention to provide a water dispenser of a refrigerator which serves to make it simple and handy for respective components thereof to be separated and re-coupled, thereby enabling easy cleaning and convenient use thereof.

In accordance with the ojects of the present invention, there is provided a water dispenser of a refrigerator so as to discharge cold water stored in a refrigenerating chamber, the water dispenser comprising:

- a front cover disposed at a front portion of a door and having a rotatable and pivotable water disposal lever;
- a cylinder member having a slide member slidingly operated according to a rotation of the water disposal lever and a water disposal outlet formed at one side thereof;
- a cold water vessel releasably disposed at an upper side of the cylinder member and for storing the cold water therein; and
- a lower cap having a valve sheet for selectively supplying the cold water stored in the cold water vessel according to operation of a slide member.

Therefore, the water dispenser according to the present invention has an advantage in that structure thereof is simple, assemblage and separation of respective components are easy it is convenient to clean, and the same enables manipulation of the water disposal lever while a vessel such as cup is held by one hand.

The water dispenser according to the present invention also has an advantage in that the cold water discharged therefrom is not dispersed or sprayed in all directions but is discharged in a straight line.

BRIEF DESCRIPTION OF THE DRAWINGS

For better understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
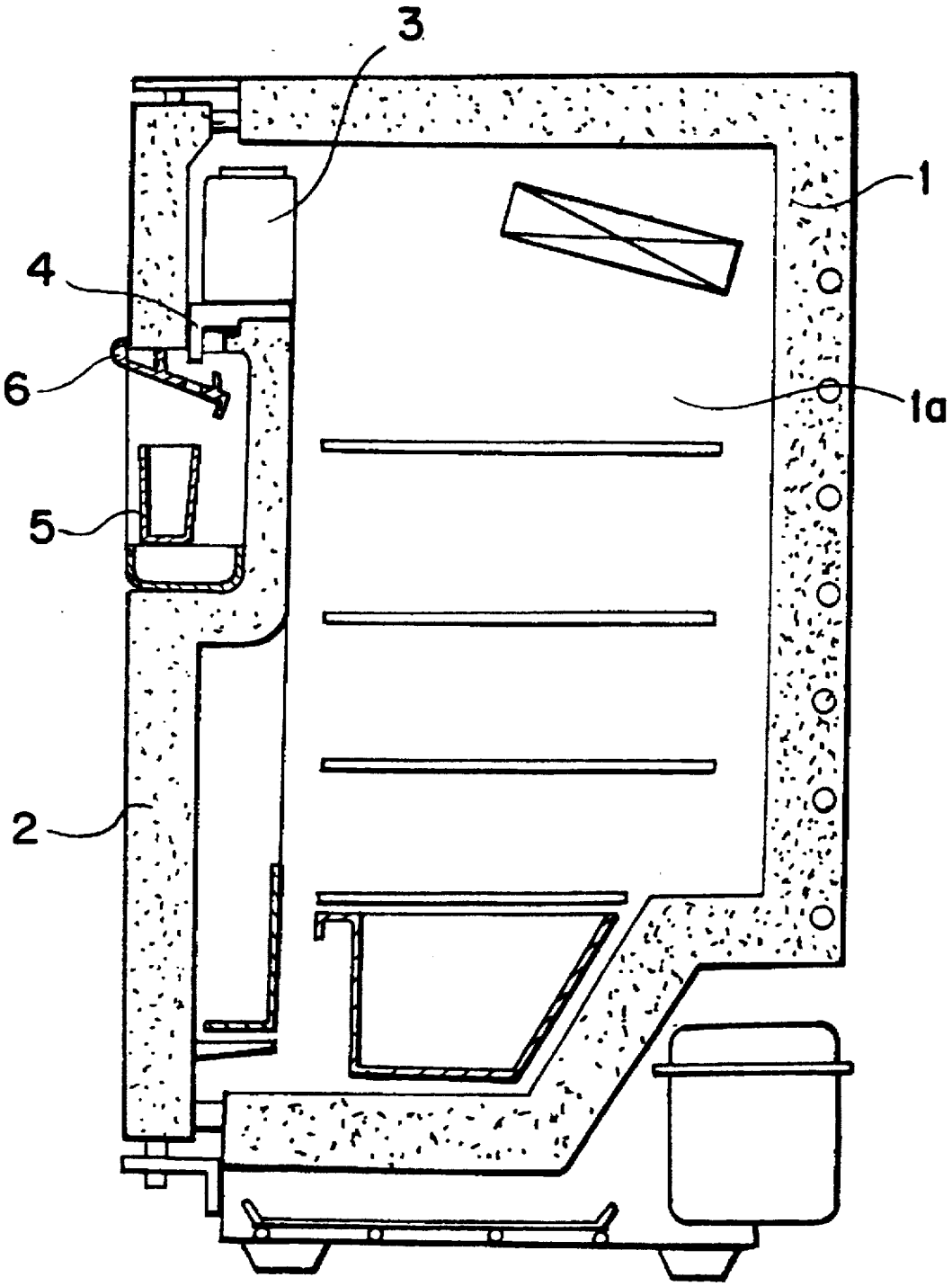
FIG. 1 (PRIOR ART)
FIG. 1 is a schematic partial sectional view of a conventional refrigerator having a water dispenser.
Figure 2:
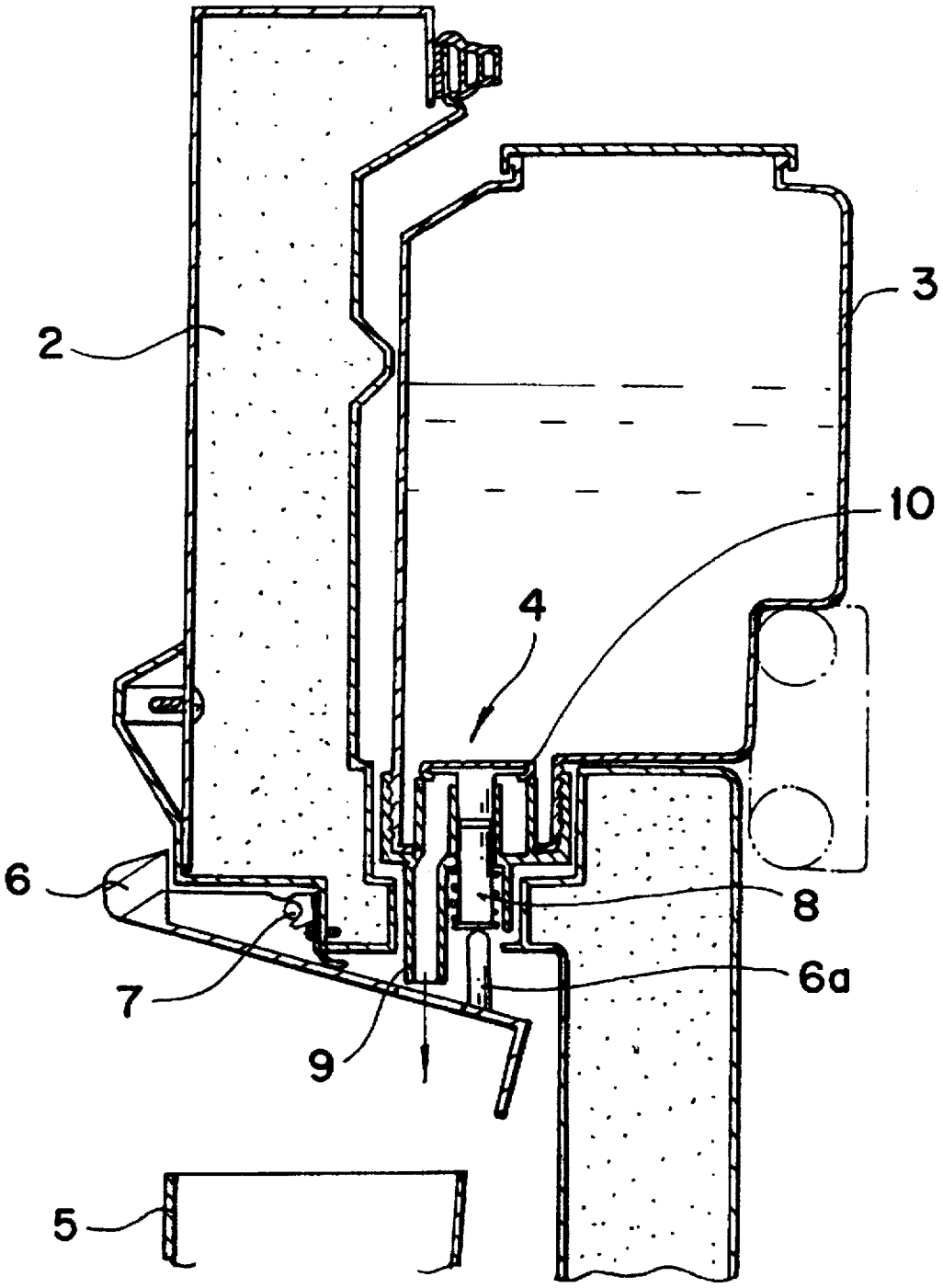
FIG. 2 (PRIOR ART)
FIG. 2 is a partial sectional view of a conventional water dispenser.
Figure 3:
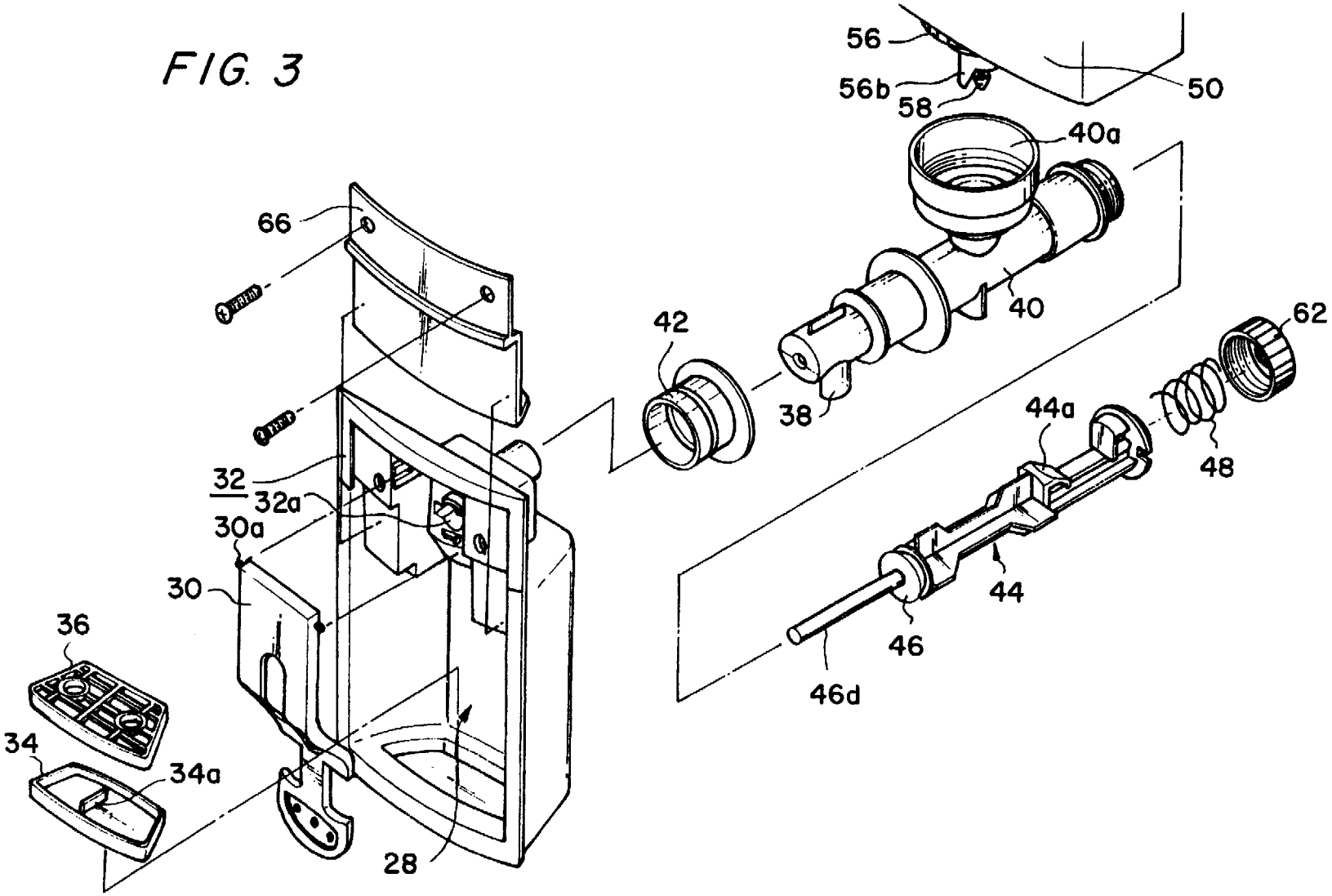
FIG. 3 is an exploded perspective view for illustrating a water dispenser of a refrigerator according to the present invention.

An embodiment of the present invention will now be described in detail with reference to the accompanying drawings from FIG. 3 to FIG. 6.

Reference numeral 20 in the drawings designates a door having an expanded insulating material 26 between an inner plate 22 and an outer plate 24, and the door 20 is formed with a water dispensing chamber 28 for dispensing cold water cooled in the refrigerating chamber.

Furthermore, the water dispensing chamber 28 is formed in a housing or front cover 34 provided at an upper side thereof with a water dispensing lever 30 having at an upper end thereof hinge axles 30*a* protrudingly formed at both sides thereof, and, at the same time, the same is assembled to a front cover 32 formed with a through hole 32*a*.

The front cover 32 is provided at a lower side thereof with a releasable dripping water accommodation or collecting member 34 formed with a protruded grip 34*a* for easy extraction thereof, the dripping water accommodation member 34 is snugly provided at an upper side thereof with a tray member 36 formed in mesh shape for the dripping water to be infused therethrough.

Meanwhile, the through hole 32*a* formed in the front cover contains a packing member 42 surrounding a cylinder member 40 formed with a water outlet 38 for dispensing of the cold water, and the cylinder member 40 contains a slide member 44 having a sealing member 46 and a slant area 44*a* at opposite ends thereof.

The slide member 44 is resiliently based toward the door 20 by a resilient spring 48 disposed at one end thereof.

The water outlet 38 has an inner periphery formed with a plurality of circumferentially spaced guiding protrusions 38*a* which serve to discharge the cold water is straight line without spraying in all directions.

Figure 5:
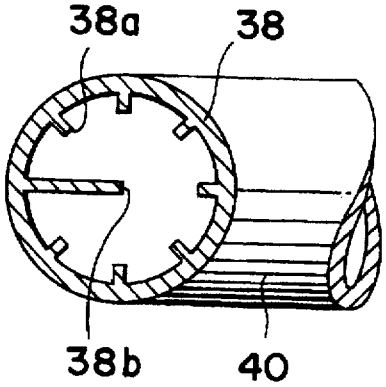
FIG. 5 is an enlarged sectional view for illustrating a water disposal outlet according to the present invention.

There is provided at least one central protrusion 38*b* extending upto an approximate center of the water outlet 38, as illustrated in FIG. 5, in order to guide the flow of the cold water when only a small quantity of the same is discharged.

Additionally, a cup-shaped receptacle 40*a* formed at an upper side of the cylinder member 40 defines a water inlet and releasably receives a cold water vessel 50 for storing a predetermined quantity of the cold water (W).

The cold water vessel 50 includes a vessel body provided at an upper side thereof with a filtering member 52 formed with a plurality of minute holes 52*a* in order to prevent infuse of foreign objects contained in the cold water (W) when the cold water (W) is introduced, and at an upper side of the cold water vessel 50, there is arranged a separable lid 54 assembled thereto.

Furthermore, the body of the cold water vessel 50 is coupled at a lower side thereof to a lower cap 56 having a cold water infuse passage 56*a* for infuse of the cold water (W) and a valve guard 56*b* projecting from one side thereof.

The cold water infuse passage 56*a* contains a resilient member 48*a* which downwardly biases a valve body 58, a lower end of which serves to contact the slant portion 44*a* during sliding operation of the slide member 44 to thereby be displaced up and down.

The valve body 58 is fixedly connected at an upper side thereof to a valve plate 60 having a elastic region for being tightly adhered to an upper end of the cold water infuse passage 56*a* to selectively discharge the cold water (W) stored in the cold water vessel 50, and the cylinder member 40 has a lid 62 to support one end of a resilient member 48 which biases the slide member 44 toward the outlet 38.

Meanwhile, the inner plate 22 is formed at an inner side thereof with a plurality of coupling protrusions 22*a*, to which a rear cover 64 having an opening 64*a* is releasably coupled.

The front cover 32 is fixedly coupled at an upper side thereof to a lid plate 66 for causing an inner surface of the water lever 30 to contact a tip end of the slide member 44.

Numeral 68 represents a vessel such as cup or the like for receiving the cold water (W) discharged through the water outlet 38 according to operation of the water disposal lever 30.

Reference numerals 70*a* and 70*b* are gaskets made of silicon.

Next, the operation of the water dispenser of a refrigerator according to the present invention will be described.

Figure 4:
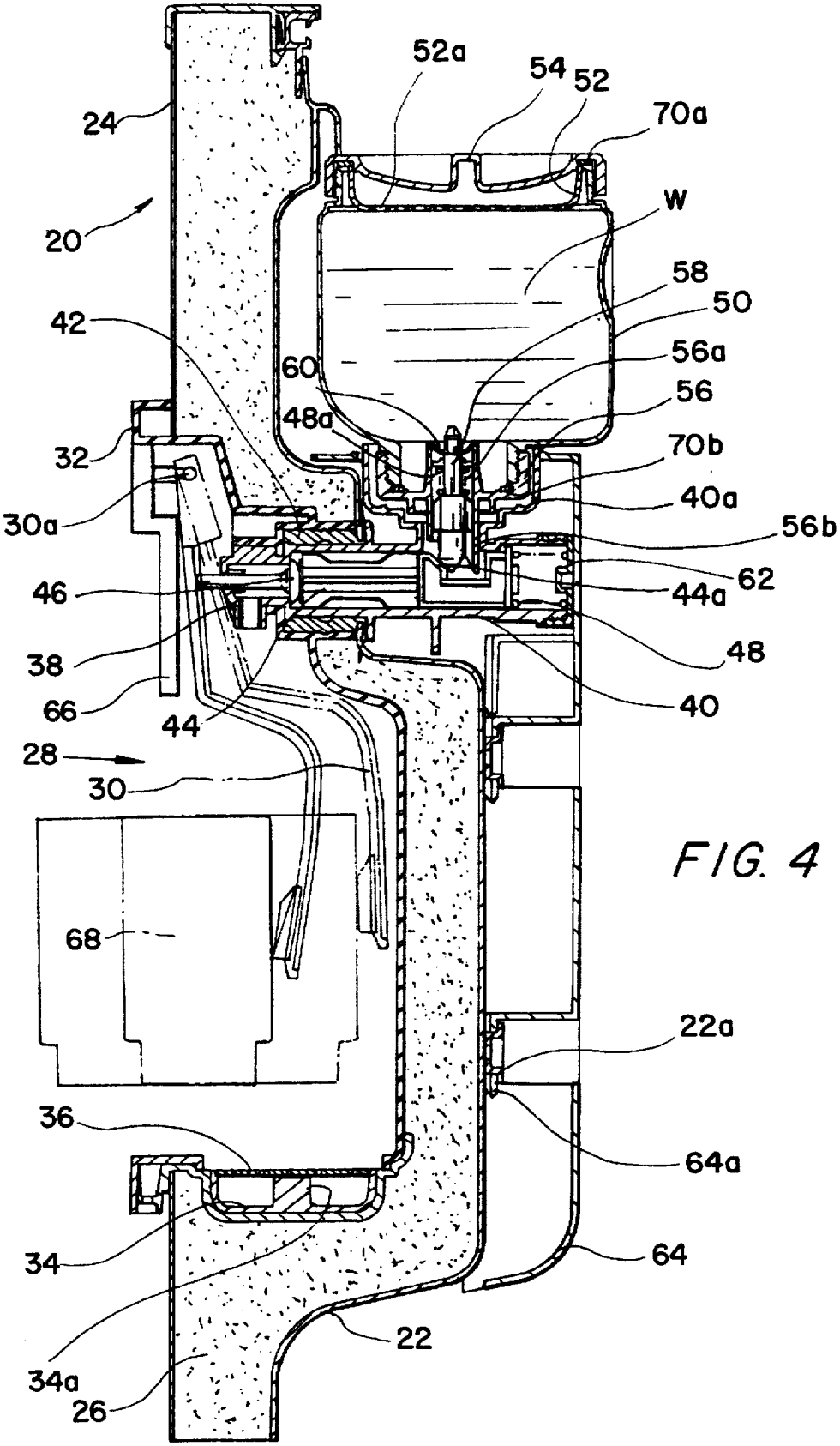
FIG. 4 is an assembled sectional view for illustrating a water dispenser of a refrigerator according to the present invention.

First of all, when the cold water (W) in the refrigerating chamber is to be dispensed, a vessel 68 such as cup or the like is positioned in the chamber 28, the lever 30 is pressed down, and is rotated to a predetermined degree around the hinge axis 30*a* to thereby move the slide member 44 in the cylinder member 40 toward the refrigerating chamber, as illustrated in FIG. 4 in broken lines.

As the slide member 44 compresses the resilient member 48 while traveling toward the refrigerating chamber, a valve-actuating surface defined by the slant portion 44*a* serves to press a lower end of the valve body 58 to raise the same, and when the valve body 58 is raised, compressing the resilient member 48*a*, the valve plate 60 rises a predetermined distance from an upper end of the cold water infuse passage 56*a*, so that the cold water (W) stored in the cold water vessel 50 is introduced into the cold water infuse passage 56*a*.

Figure 6:
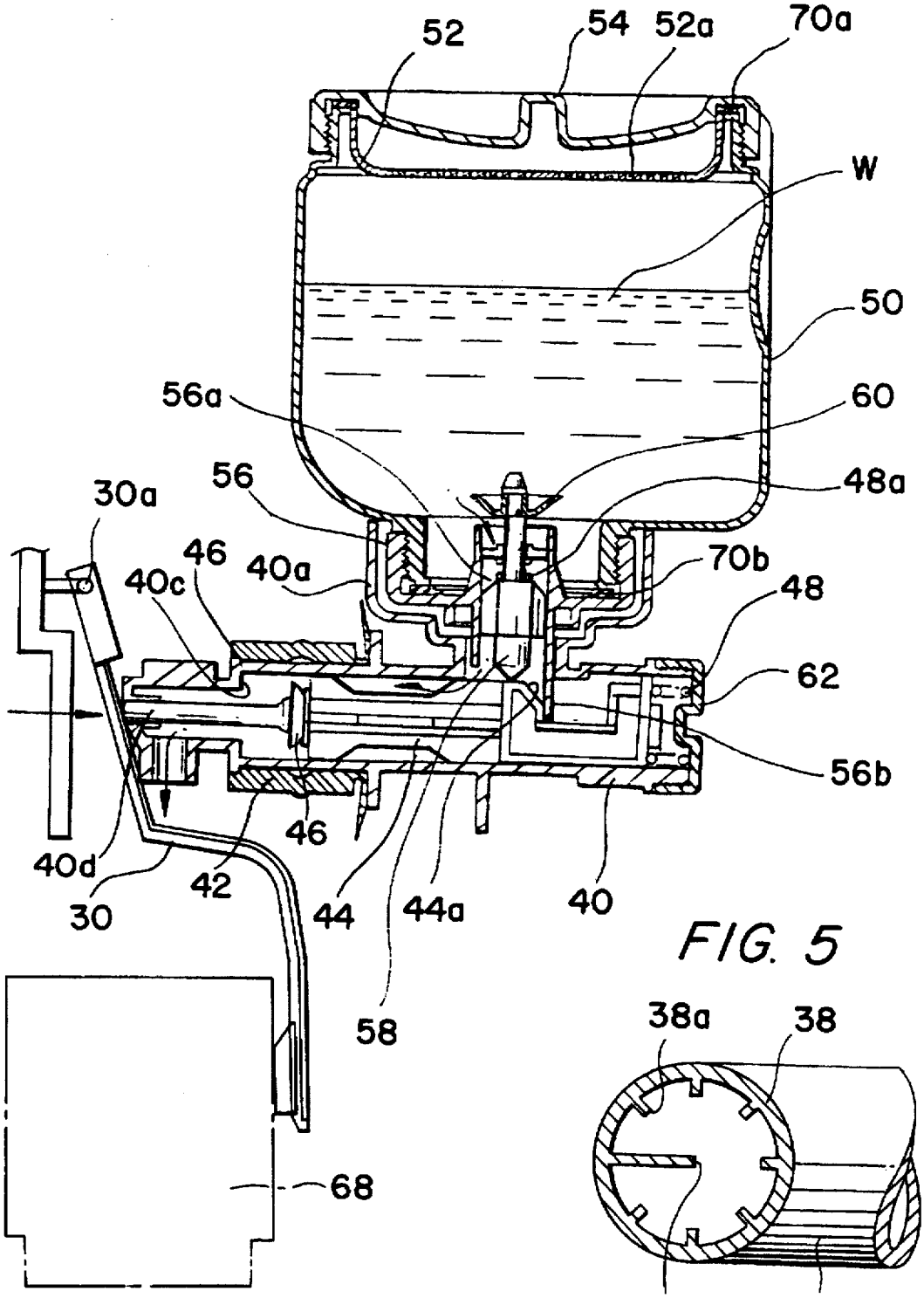
FIG. 6 is an enlarged sectional view of principal parts for illustrating how the water dispenser according to the present invention is operated.

Successively, the cold water (W) infused into the cold water infuse passage 56*a* flows into the cylinder member 40 and into the vessel 68 via the water outlet 38 as illustrated in FIG. 6.

Because of the plurality of guiding protrusions 38*a*, and/or 38*b* the flow of the discharged cold water (W) is not dispersed or sprayed in all directions, but rather flows in a straight line.

Meanwhile, when the force applied to the lever 30 is released, the slide member 44 positioned toward the refrigerating chamber in the cylinder member 40 returns to an original state thereof by the force of the resilient member 48, and, at the same time, the slant portion 44*a* is dislodged from the valve body 58, so that the valve body 58 is caused to travel downward by the force of the resilient member 48*a*.

At this time, the valve body 58 travels downward, and, at the same time, the valve plate 60 goes downward to thereby close the upper end of the cold water infuse passage 56*a*, thereby terminating supply of the cold water (W) stored in the cold water vessel 50, and simultaneously terminating discharge of the cold water (W) into the water disposal outlet 38.

In other words, infuse of the cold water (W) into the cold water infuse passage 56*a* upon the closing operation of the valve plate 60 is stopped, and, at the same time, when the slide member 44 elastically slid by the resilient member 48, the cold water (W) in the cylinder member 40 is discharged into the vessel 68 through the water disposal outlet 38, thereby leaving no residual water in the water disposal outlet 38.

At this time, the cold water (W) infused into the cylinder member 40 through the cold water infuse passage 56*a* formed in the inner side of the lower cap 56 is not discharged because the sealing member 46 is tightly pushed against a shoulder 40*c* of the cylinder member 40 by the resilient member 48, and when tip end 40*d* of the slide member 44 returns to the original state by the elastic region of the resilient member 48, the water pushes the lever 30 to the original state.

Furthermore, when the cold water (W) in the cold water vessel 50 is to be supplemented, the cold water vessel 50 is lifted and separated from the cylinder member 40, whereafter the lid 54 is opened, and an appropriate quantity of cold water (W) is introduced into the vessel 50 through the filtering member 52.

Infuse of foreign objects contained in the cold water (W) into the cold water vessel 50 is prevented by the plurality of minute holes 52*a* in the filtering member 52 and accidental discharge of the cold water (W) caused by erroneous operation of the valve body 58 during supplementation of the cold water (W) can be avoided by valve guard 56*b* formed on the lower cap 56 which tends to shield the body 58 from being contacted.

Meanwhile, when the rear cover 64 and its openings 64*a* are slid upward when the cold water vessel 50 has been removed, it is possible to separate, the rear cover 64 from the inner plate 22 and its protrusions 22*a*. After the rear cover 64 is separated, the cylinder member 40 is separated from the through hole 32*a*, and the lid 62 is separated from the cylinder member 40, thereby enabling separation of the cylinder member 44, so that it becomes easy to clean the cylinder member 40 and the slide member 44 and the like.

Assembling of the cylinder member 40, slide member 44 and the rear cover 64 can be performed by reversing the separating process.

The dripping water resulting from mis-placement of the vessel 68 during water disposal is stored in the dripping water accommodation member 34 through the tray member 36, and the dripping water stored in the dripping water accommodation member 34 can be taken by manually grasping the grip protrusion 34*a* after the tray member 36 is separated therefrom, so that disposal of the dripping water is facilitated.

As is apparent from the foregoing, there is an advantage in the water dispenser of a refrigerator according to the present invention in that it is easily assembled and disassembled, so that, cleaning thereof is facilitated, and manipulation off the disposal lever can be done by one hand.

There is another advantage in the water dispenser of a refrigerator according to the present invention in that the cold water discharged through the discharge outlet is not dispersed or sprayed in all directions onto surrounding surfaces but is dispensed in a straight line.

There is still another advantage in the water dispenser according to the present invention in that same can be mounted not only at an upper side of a door but also at a lower side of the door, so that many modifications and variations are possible in light of the above teaching.

What is claimed is:

1. A water dispensing apparatus adapted to be mounted in a refrigerator door, comprising:

a housing defining a water dispensing chamber adapted to receive a cup;

a manually actuable lever mounted to the housing for pivotal movement relative thereto;

a hollow cylinder mounted to the housing and forming a water conduit having a downwardly facing water outlet disposed in the chamber, and an upwardly facing water inlet spaced from the water outlet;

a slide mounted for reciprocation in the water conduit and positioned to be contacted by the lever to be pushed thereby in a first direction, the slide including a valve-actuating surface;

a water storage vessel removably mounted to the cylinder such that a water passage disposed at a lower portion of the vessel communicates with the water inlet of the cylinder; and a valve mechanism mounted in the water passage for being displaced to a passage-opening position in response to be contacted by the actuating surface of the slide when the slide is pushed in the first direction by the lever.

2. The water dispensing apparatus according to claim 1 wherein the water storage vessel includes a vessel body and a cap detachably mounted to a lower portion thereof; the cap forming the water passage and carrying the valve mechanism.

3. The water dispensing apparatus according to claim 2 wherein the cap includes a downwardly projecting valve guard for preventing the valve mechanism from being accidentally contacted when the vessel has been removed from the cylinder.

4. The water dispensing apparatus according to claim 2 wherein the valve mechanism is spring biased downwardly, and a lower portion of the valve mechanism is arranged to be contacted by the valve-actuating surface of the slide to be raised thereby against the spring bias, the valve-actuating surface being inclined relative to vertical.

5. The water dispensing apparatus according to claim 2 wherein the water inlet of the cylinder includes a cup-shaped receptacle facing upwardly for receiving the cap of the water storage vessel.

6. The water dispensing apparatus according to claim 1 including a lid covering an end of the cylinder disposed opposite the water outlet, a spring acting between the lid and the slide for biasing the slide toward the lever, the lid being removable to enable the spring and slide to be removed from the cylinder.

7. The water dispersing apparatus according to claim 6 wherein an end of the slide facing the lever projects through a hole of the housing to engage the lever.

8. The water dispersing apparatus according to claim 1 further including a water collecting member disposed at a lower end of the chamber and covered by a removable mesh-shaped tray.

9. The water dispensing apparatus according to claim 8 wherein the water collecting member includes an upward protrusion to be manually gripped for removal of the water collecting member.

10. The water dispensing apparatus according to claim 1 wherein an inner periphery of the water outlet includes circumferentially spaced, radially inward protrusions extending in a direction of water flow for guiding the water for travel in a straight direction from the water outlet.

11. The water dispensing apparatus according to claim 10 wherein most of the protrusions terminate well short of a center of the water outlet, and one of the protrusions extends substantially to the center.

12. The water dispensing apparatus according to claim 1 wherein the water storage vessel includes at an upper portion thereof a filter for removing foreign objects from water being introduced into the vessel.

13. A refrigerator including a refrigerating compartment, a door, and a water dispensing apparatus mounted in the door comprising:

a housing mounted to the door and defining a water dispensing chamber accessible to a user without opening the door, to receive a cup into which cold water is to be dispensed;

a manually actuable lever mounted to the housing for pivotal movement relative thereto;

a hollow cylinder mounted to the housing and extending into the refrigerating compartment, the cylinder forming a water conduit having a downwardly facing water outlet disposed in the chamber, and an upwardly facing water inlet spaced from the water outlet;

a slide mounted for reciprocation in the water conduit and positioned to be contacted by the lever to be pushed thereby in a first direction, the slide including a valve-actuating surface;

a water storage vessel removably mounted to the cylinder such that a water passage disposed at a lower portion of the vessel communicates with the water inlet of the cylinder; and a valve mechanism mounted in the water passage for being displaced to a passage-opening position in response to be contacted by the actuating surface of the slide when the slide is pushed in the first direction by the lever.

* * * * *